United States Patent [19]

Toiyama

[11] Patent Number: 4,842,238

[45] Date of Patent: Jun. 27, 1989

[54] SEAT DAMPER ASSEMBLY

[75] Inventor: Yoshiro Toiyama, Gifu, Japan

[73] Assignee: Kayaba Kogyo K.K., Japan

[21] Appl. No.: 204,590

[22] Filed: Jun. 9, 1988

[30] Foreign Application Priority Data

Jun. 12, 1987 [JP] Japan ..... 62-90561[U

[51] Int. Cl.[4] ..... F16M 13/00

[52] U.S. Cl. ..... 248/562; 188/322.17; 267/131; 248/161; 248/622

[58] Field of Search ..... 248/562, 566, 623, 622, 248/418, 161, 157; 297/347; 267/131, 132; 188/322.11, 322.17; 114/363

[56] References Cited

U.S. PATENT DOCUMENTS

| | | | |
|---|---|---|---|
| 3,885,764 | 5/1975 | Pabreza | 248/157 X |
| 4,108,416 | 8/1978 | Nagase et al. | 248/566 |
| 4,183,689 | 1/1980 | Wirges et al. | 248/161 X |
| 4,242,826 | 1/1981 | Wirges | 267/131 |
| 4,345,748 | 8/1982 | Wössner et al. | 188/322.17 X |
| 4,580,749 | 4/1986 | Howard | 248/161 |
| 4,613,106 | 9/1986 | Tornero | 297/347 X |
| 4,693,442 | 9/1987 | Sills | 248/157 X |

*Primary Examiner*—Ramon O. Ramirez
*Attorney, Agent, or Firm*—McGlew & Tuttle

[57] ABSTRACT

A damper assembly, for supporting a seat of a vehicle such as a small-sized motor boat, comprises a lower bracket adapted to be attached to a floor of the vehicle, an upper bracket adapted to be attached to the seat, and a damper mounted between the upper and lower brackets. The damper includes an outer tube extending upwardly from the lower bracket, an inner tube extending downwardly from the upper bracket and telescopically inserted in the outer tube, and a guide tube secured to the lower bracket and telescopically inserted in the inner tube. The inner and guide tubes are connected together so as to allow the inner tube to slide longitudinally on the guide tube but so as to prevent the inner tube from rotation or turning about the guide tube.

3 Claims, 2 Drawing Sheets

SEAT DAMPER ASSEMBLY

BACKGROUND OF THE INVENTION

1. Field of the Invention:

The present invention relates to a seat damper assembly having a shock-absorber, and more particularly to a seat damper assembly suitable for a seat support structure of a vehicle, such as a small-sized motor boat, which is subject to violent vertical vibrations.

2. Description of the Prior Art:

While a motor boat is running at high speed, the crests of waves lap the bottom of the boat violently. In order to absorb the impact which a seat receives due to the wave lapping, it is known to use a damper in a support structure of the seat.

Further, while the boat is making a turn, it is necessary to prevent the seat from inadvertent rotation or turning. In order to cope with this problem, various improvements of the seat support structure have been proposed such as in Japanese Utility Model Publications Nos. 2397/1974 and 44170/1977.

In the seat support structure of Japanese Utility Model Publication No. 2397/1974, upper and lower brackets are connected together by means of links. However, since the links project out of the support structure so as to reduce the space around the feet of a seated person, there is a danger that the feet of the seated person would be caught by the links. Further, this support structure is heavy in weight.

In the seat support structure of Japanese Utility Model Publication No. 44170/1977, there are provided between outer and inner tubes a guide groove formed in the outside surface of the inner tube and a guide pin projecting from the inside surface of the outer tube and received in the guide groove. This arrangement is advantageous in that there is no part projecting out of the support structure. However, since the upper portion of the guide groove formed in the inner tube is exposed, seawater would easily enter the tubes, which are difficult to clean, from the exposed upper portion of the guide groove, thus causing the interior of the support structure to gather rust easily. Consequently, end portions of the tubes must be covered by a stretchable cover such as in the form of bellows, which is relatively expensive.

SUMMARY OF THE INVENTION

It is therefore an object of the present invention to provide a seat damper assembly which has various functions as a seat support structure of a vehicle and which makes the connecting portion between outer and inner tubes proof against dust and moisture and resistant to wear.

According to the present invention, a seat damper assembly comprises: upper and lower brackets; a damper disposed between the upper and lower brackets; outer and inner tubes extending from the upper and lower brackets, respectively, and telescopically connected together; a bearing member mounted on an upper end of the outer tube and tightly contactable with a periphery of the inner tube; a guide tube connected to the lower bracket and inserted in the inner tube; means on the guide tube and the inner tube for preventing the guide tube and the inner tube from mutual rotation or turning; and an abrasion-proof frictional member disposed over contact surfaces of the rotation preventing means.

Many other objects, features and additional advantages of the present invention will become manifest to those versed in the art upon making reference to the following detailed description and the accompanying sheet of drawing in which preferred structural embodiments incorporating the principles of the present invention are shown by way of illustrative example.

DETAILED DESCRIPTION

Figure 1:
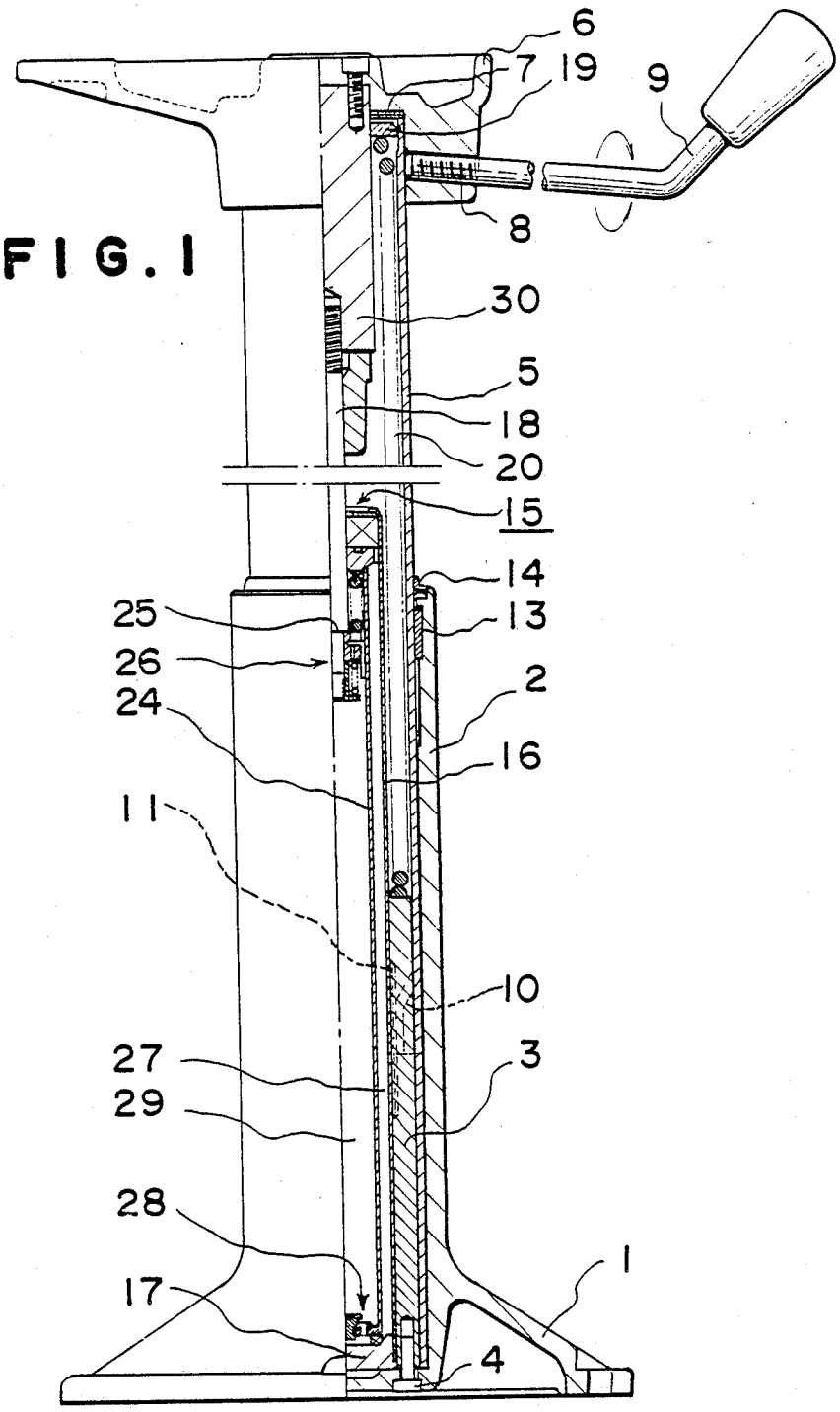
FIG. 1 is a front elevational view, partially in vertical cross section, of a seat damper assembly according to one embodiment of the present invention.

The principles of the present invention are particularly useful when embodied in a seat damper assembly such as shown in FIG. 1.

The seat damper assembly generally comprises an inner tube (described below) 5, an outer tube 2 integral with and projecting from a lower bracket 1 fixedly secured to a floor board (not shown), and a guide tube 3 inserted upright in a lower portion of the outer tube 2 from the bottom side of the lower bracket 1. The lower end of theguide tube 3 is fixedly secured to the bottom of the lower bracket 1 by a screw 4.

The upper end of the inner tube 5 is rotatably connected to an upper bracket 6 via a back plate 7 composed of a resin plate and a metal plate. A seat (not shown) is to be attached to the upper bracket 6. The upper bracket 6 has in its side wall a threaded hole 8 through which one end of a lever 9 threadedly extends so as to abut against the peripheral surface of the inner tube 5. Having been tighten by the lever 9, the inner tube 5 and the upper bracket 6 are joined together as a unit.

The lower portion of the inner tube 5 has on its periphery a radially inwardly bulged projection 10. The guide tube 3 has in its periphery a groove 11 complementary in cross-sectional shape with the projection 10 and received therein.

Figure 2:
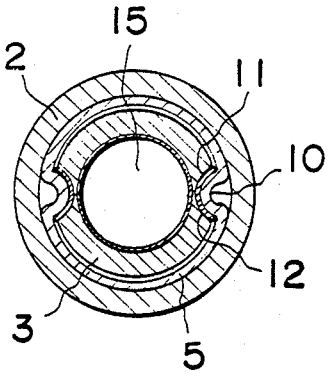
FIG. 2 is a horizontal cross-sectional view of the seat damper assembly, showing a rotation preventing means on outer and inner tubes.

As shown in FIG. 2, a friction member 12 in the form of an abrasion-proof curved plate made of metal or synthetic resin is disposed between the projection 10 and the groove 11.

The friction member 12 may be coextensive with the groove 11 or the projection 10. The friction member 12 may be formed integrally with the projection 10.

Further, a bearing 13 is mounted on an upper inner peripheral surface of the outer tube 2 and tightly and frictionally engages an upper outer peripheral surface of the inner tube 5. A dust seal 14 is attached to the upper end of the outer tube 2 for preventing dust and waterdrops from penetrating through the junction between the outer tube 2 and the inner tube 5. A damper 15 is inserted in the outer and inner tubes 2, 5. The damper 15 includes an inner cylinder 24, a piston rod 18 inserted in the inner cylinder 24 via a piston 24 having a valve 26, an outer cylinder 16 concentric with the inner cylinder 24, a reservoir 27 defined between the outer and inner cylinders 16, 24, and a base valve 28 for controlling the passage of oil between the reservoir 27 and an oil chamber 29. A bottom cap 17 of the outer cylinder 16 is fixedly secured to the bottom plate of the lower bracket 1 by the bolt 4 in confronting relation to the bottom plate, with an outer peripheral edge of the bottom cap 17 abutting against the lower end of the guide tube 3. The piston rod 18 is threadedly connected at its distal end to a connecting member 30 mounted centrally on the upper bracket 6.

In a gap between the outer cylinder 16 of the damper 15 and the inner tube 5, a compression spring 20 is mounted between a spring holder 19 at the upper end of the inner tube 5 and the upper end of the guide tube 3 to normally urge the inner tube 5 upwardly or in the direction of expanding.

Figure 3:
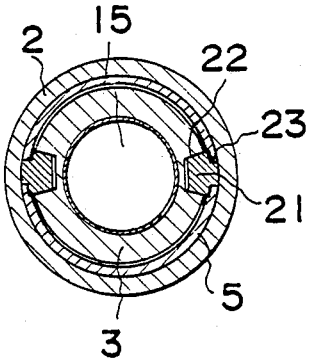
FIG. 3 is a view similar to FIG. 2, showing a modification of the rotation preventing means.

FIG. 3 is a view similar to FIG. 2, illustrating a modification of the seat damper assembly of FIGS. 1 and 2. In this modified damper assembly, a frictional projection 21 made of an abrasion-proof material is used in place of the projection 10 and the groove 11 of the previousembodiment. Further, the guide tube 3 has a vertical groove 22, and the inner tube 5 has in its end surface a hole 23. The friction projection 21 is fitted in the hole 23 and is slidably received in the vertical groove 22.

With the seat damper assembly of the present invention, since the projection 10 of the inner tube 5 is slidably received in the groove 11, the inner tube 5 can be moved vertically or in the direction of thrusting but is prevented from rotation or turning with respect to the guide tube 3. Partly because the inner tube 5 is fixedly secured to the upper bracket 6 by means of the lever 9, and partly because the guide tube 3 is fixed secured to the lower bracket 1, the upper bracket 6 and hence the seat is prevented from inadvertent rotation or turning with respect to the lower bracket 1.

When it is necessary to shift the orientation of the nonillustrated seat, the lever 9 is rotated so as to untighten the upper bracket 6 from the inner tube 5, and then the upper bracket 6 is turned through a desired angle, and finally the upper bracket 6 is tightened to the inner tube 5 by reversely rotating the lever 9.

In the embodiment of FIG. 1, since the abrasion-proof friction member 12 is disposed between the projection 10 of the inner tube 5 and the groove 11 of the guide tube 3, the inner tube 5 is smoothly slidable on the guide tube 3 with minimum wear of the projection 10 and the groove 11.

Likewise, in the embodiment of FIG. 3, since the abrasion-proof friction projection 21 attached to the inner tube 5 is slidably received in the vertical groove 22 of the guide tube 3, the inner tube 5 is smoothly slidable on the guide tube 3, thus reducing wear of the groove 22 and the friction projection 21 to a minimum.

As mentioned above, according to the seat damper assembly of the present invention, partly because the inner tube is vertically slidably connected to the guide tube and is prevented from rotation or turning with respect to the guide tube, and partly because the guide tube is fixedly secured to the lower bracket, the inner tube and thus the seat is prevented from rotation or turning.

Further, since the guide tube is disposed within the outer tube, there is no part projecting out of the support structure of the vehicle which part otherwise would restrict the movement of the feet of a seated person. Since it is unnecessary to provide any anti-rotation means between the outer and inner tubes, the sealing member mounted at the upper end of the outer tube can be brought in tight contact with the peripheral surface of the inner tube.

In addition, since without any auxiliary part such as bellows, it is possible to prevent dust and seawater to penetrate the seat support structure from the contact portions between the outer and outer tubes, an improved-appearance and inexpensive seat support structure can be achieved.

With the seat damper assembly the present invention, following advantageous results can be achieved:

(1) Partly because the inner tube and the guide tube contact each other only at their restricted portions, and partly because the abrastion-proofe friction member is disposed between the contacting portions of the tubes, it is possible to reduce wear of the tubes to a minimum so that the tubes can be used for a long time.

(2) Because there is no play between the inner and guide tubes to make these tubes proof against seawater and dust, the seat damper assembly can work stably and accurately for a long time.

(3) The abrasion-proof friction member, which is expensive, is used only locally.

(4) The guide tube, for example, can be made of synthetic resin, and in such event, the guide tube would be free from rust, thus making the seat damper assembly particularly suitable for the seat support structure of a motor boat.

What is claimed is:

1. A seat damper assembly for supporting a seat of a vehicle, comprising:

(a) a lower bracket adapted to be attached to a floor of the vehicle;

(b) an upper bracket adapted to be attached to the seat; and (c) a damper mounted between said upper and lower brackets and including (1) an outer tube extending upwardly from said lower bracket and terminating short of said upper bracket, (2) an inner tube extending downwardly from said upper bracket and telescopically inserted into said outer tube, (3) a sealing member mounted on an upper end of said outer tube and slidingly contacting an outer peripheral surface of said inner tube so as to prevent dust and water from penetrating into said outer and inner tubes, (4) a guide tube connected to said lower bracket and telescopically inserted in said inner tube, (5) means connecting said inner tube and said guide tube together so as to allow said inner tube to slide vertically on said guide tube but so as to prevent said inner tube from rotation or turning about said guide tube, and (6) an abrasion-proof friction member disposed between said inner and guide tubes at said connecting means.

2. A seat damper assembly according to claim 1, wherein said connecting means includes a longitudinal groove formed in one of said inner and guide tubes, and a projection extending from the other tube and slidably received in said longitudinal groove, and wherein said friction member is disposed between said groove and said projection and is a curved thin plate of an obrasion-proof material.

3. A seat damper assembly according to claim 2, wherein said connecting means includes a longitudinal groove formed in one of said inner and guide tubes, and a projection extending from the other tube and slidably received in said longitudinal groove, said projection being composed of said abrasion-proof friction member.

* * * * *